US005832646A

United States Patent [19]

Albin et al.

[11] Patent Number: 5,832,646

[45] Date of Patent: Nov. 10, 1998

[54] SUPPORT SYSTEM FOR PICTURE FRAMES

[76] Inventors: Stephen D. Albin; Michael T. Albin, both of 797 Manor Way, Los Altos, Calif. 94024

[21] Appl. No.: 794,482

[22] Filed: Feb. 4, 1997

Related U.S. Application Data

[63] Continuation of Ser. No. 475,487, Jun. 7, 1995, which is a continuation-in-part of Ser. No. 225,901, Apr. 11, 1994, abandoned.

[51] Int. Cl.[6] ..... A47G 1/06

[52] U.S. Cl. ..... 40/762; 40/761; 40/757

[58] Field of Search ..... 40/700, 745, 746, 40/761, 762, 757; 248/455, 456, 450, 297.21; 160/118, 196.1, 199, 200; 411/84, 85

[56] References Cited

U.S. PATENT DOCUMENTS

| | | | |
|---|---|---|---|
| 2,413,669 | 12/1946 | Whitcombe | 411/85 |
| 2,450,495 | 10/1948 | Ullmann | 40/762 |
| 2,581,843 | 1/1952 | Edwards | 40/745 X |
| 3,715,097 | 2/1973 | Kalajian | 248/455 X |
| 4,122,617 | 10/1978 | Nielsen | 40/785 |
| 4,229,892 | 10/1980 | Hueter et al. | 40/746 |
| 4,422,613 | 12/1983 | Cray et al. | 248/473 |
| 4,428,135 | 1/1984 | Sobel | 40/782 |
| 4,704,814 | 11/1987 | Astolfi | 40/761 |
| 4,858,351 | 8/1989 | Sewell et al. | 40/712 |
| 5,082,230 | 1/1992 | Chang | 248/455 X |
| 5,095,641 | 3/1992 | Dahl | 40/721 |
| 5,101,586 | 4/1992 | Zennedjian | 40/761 |
| 5,149,038 | 9/1992 | VanCleve | 248/297.21 |
| 5,154,385 | 10/1992 | Lindberg et al. | 248/297.21 X |
| 5,365,682 | 11/1994 | Eubank, Jr. | 40/746 |

FOREIGN PATENT DOCUMENTS

| | | | |
|---|---|---|---|
| 2468784 | 5/1981 | France | 411/85 |

OTHER PUBLICATIONS

MidLand–Ross Corporation Catalog "Kindorf Channels & Accessories" Jun. 27, 1967.

*Primary Examiner*—Peter M. Cuomo
*Assistant Examiner*—James O. Hansen
*Attorney, Agent, or Firm*—Beyer & Weaver, LLP

[57] ABSTRACT

A picture frame support system is disclosed. In one aspect of the invention, a variety of free standing support arrangements are provided that cooperate with a support rail on the picture frame. The support rail defines a channel with a constricted opening. The support arrangement includes a coupling mechanism sized appropriately to fit within the frame support rail channel. An elongated support arm extends transversely from the coupling mechanism to support the frame. In one embodiment, a cam based coupling mechanism is described. In another, a slider based coupling mechanism that utilizes a pair of threaded studs to engage the support rail channel. In another aspect of the invention, an independent frame support rail channel is disclosed that may be adhered to a mount board or the like to facilitate hanging and/or supports such as the free standing supports described above.

3 Claims, 9 Drawing Sheets

SUPPORT SYSTEM FOR PICTURE FRAMES

This application is a continuation of application Ser. No. 08/475,487 filed Jun. 7, 1995, which is in turn a continuation-in-part of application Ser. No. 08/225,901 filed Apr. 11, 1994, which is incorporated herein by reference in its entirely.

BACKGROUND OF THE INVENTION

The present invention relates generally to support systems for picture frames, picture mount boards and the like. In one aspect of the invention, various free standing support members are described. In another aspect of the invention, a support rail channel suitable for attachment to a flat backed surface is described. These devices may be used either standing alone or in cooperation with one another in order to support a picture frame, mount board or the like.

There are a wide variety of devices that are conventionally used to frame pictures, photographs, drawings, diplomas and a variety of other objects. Picture frames take a wide variety of forms including metal frames, wooden frames, plastic frames, mount boards, picture mats, plaques, etc.. In the description herein, the terms picture frame and mount board are intended to generically cover all of these devices. Such picture frames come in a wide variety of shapes, colors and materials. Often it is desirable to hang the picture frame on a wall. It is also often desirable to set the picture frame as a free standing device. A wide variety of support mechanisms are well known to the art. By way of example, in free standing picture frames, collapsible cardboard cutouts are frequently used. Another support system is disclosed in U.S. Pat. No. 5,095,641. In many types of frames, a wire is attached to the back so that the wire can be engaged with a wall mounted hook in order to support the picture frame.

Still another support system is provided in some metal frames in particular. Specifically, a channel type arrangement is provided around the perimeter of the back and/or front side of the picture frame. Wall mounted supports are sometimes used in conjunction with such channels to support the frame. The channels have internal edges so that they will engage a lip on the wall support. Although there are currently a variety of picture frame support mechanisms available on the market, there is an ongoing need for improved support arrangements. Accordingly, it is an object of the present invention to provide improved picture support systems.

SUMMARY OF THE INVENTION

To achieve the foregoing and other objects and in accordance with the purpose of the present invention, a picture frame support system is disclosed. In one aspect of the invention, a free standing support arrangement is provided that cooperates with a support rail on the picture frame. The support rail defines a channel with a constricted opening. The support arrangement includes a coupling member sized appropriately to be received within and releasably engaged with the rail channel. An elongated support arm extends transversely from the coupling member. The coupling member cooperates with an inner surface of the channel to releasably secure the support arrangement to the frame support rail. When secured, the support arm extends outwardly away from the rail channel to support the frame in a free standing manner.

In one preferred embodiment, the coupling member takes the form of a cam member. In another, the coupling member includes a slider having threaded holes extending there through, and threaded studs arranged to threadably engage the threaded holes. In one described arrangement of the cam member, the cam member substantially has the shape of a parallelogram and includes notches formed adjacent diagonally opposed corners of the parallelogram to form fingers that assist in latching the cam mechanism.

In another aspect of the invention, an independent frame support rail is disclosed that may be adhered to a mount board or the like to facilitate hanging and/or supports such as the free standing support described above. The support rail includes a channel member having an elongated web and a pair of arms extending substantially perpendicularly from one side of the web. The web and arms cooperating to define a trough. Each arm has an inward facing lip. The lips cooperate to form an opening to the channel trough which is narrower in width than the width of the trough. A double-sided adhesive tape is adhered to the back side of the web for attaching the rail to the mount board.

BRIEF DESCRIPTION OF THE DRAWINGS

The invention, together with further objects and advantages thereof, may best be understood by reference to the following description taken in conjunction with the accompanying drawings in which.

DETAILED DESCRIPTION OF THE INVENTION

Figure 1:
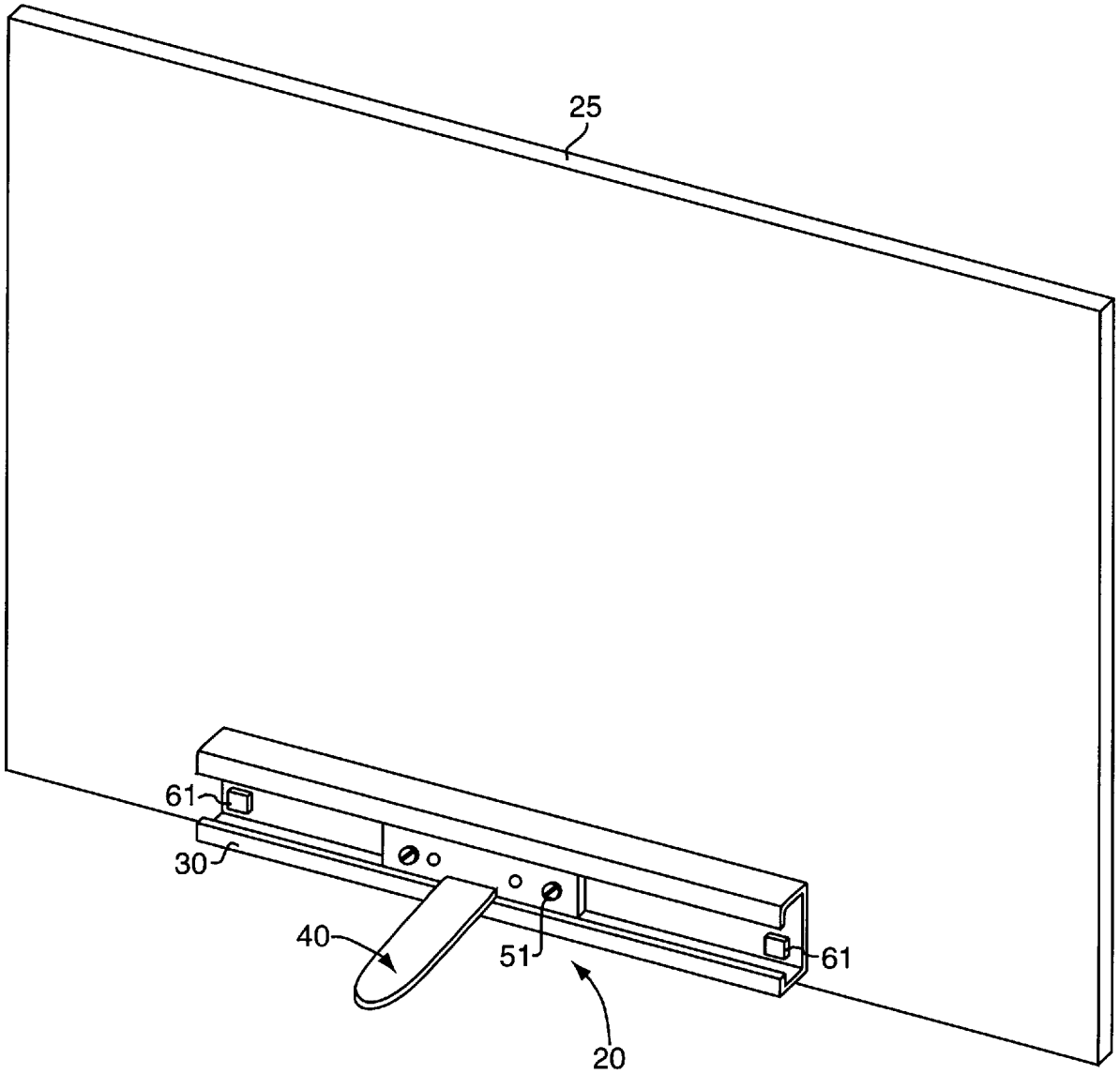
FIG. 1 is a diagrammatic back perspective view of a mount board incorporating a free standing support arrangement and a rail support channel in accordance with one aspect of the present invention.

Referring initially to FIG. 1, a preferred embodiment of the present invention will be described. As seen therein, a frame support system 20 is attached to a mount board 25. The frame support system 20 includes two major components. The first is a support rail 30 and the second is a free standing arm support 40. In the embodiment shown, the arm support 40 takes the form of a slider based arm support. The support rail channel 30 is highlighted in FIG. 3 while the slider arm support 40 is highlighted in FIGS. 4 and 5.

Figure 2:
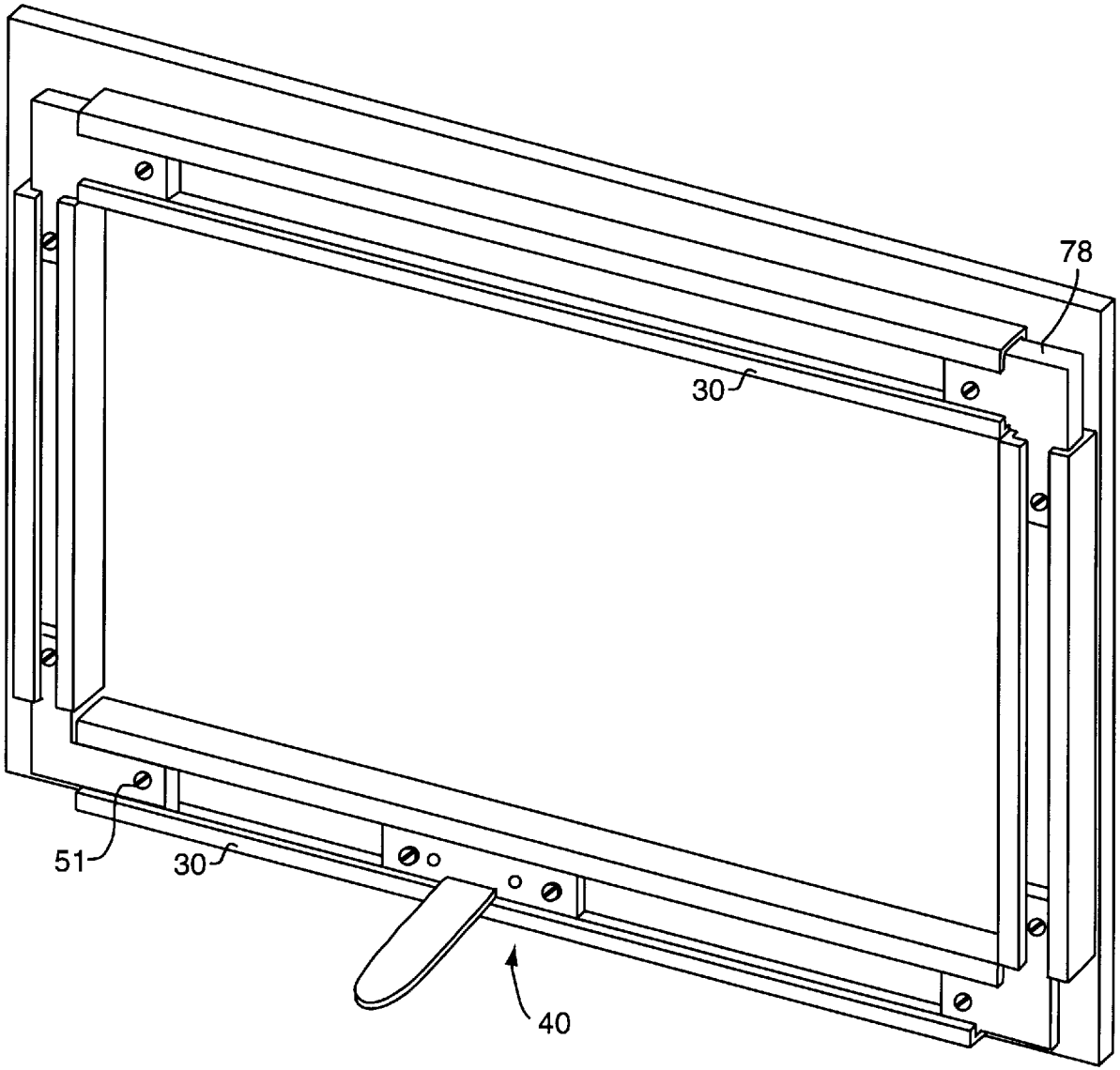
FIG. 2 is a diagrammatic back perspective view of a mount board incorporating a free standing support arrangement and a perimeter rail system in accordance with the present invention.
Figure 3:
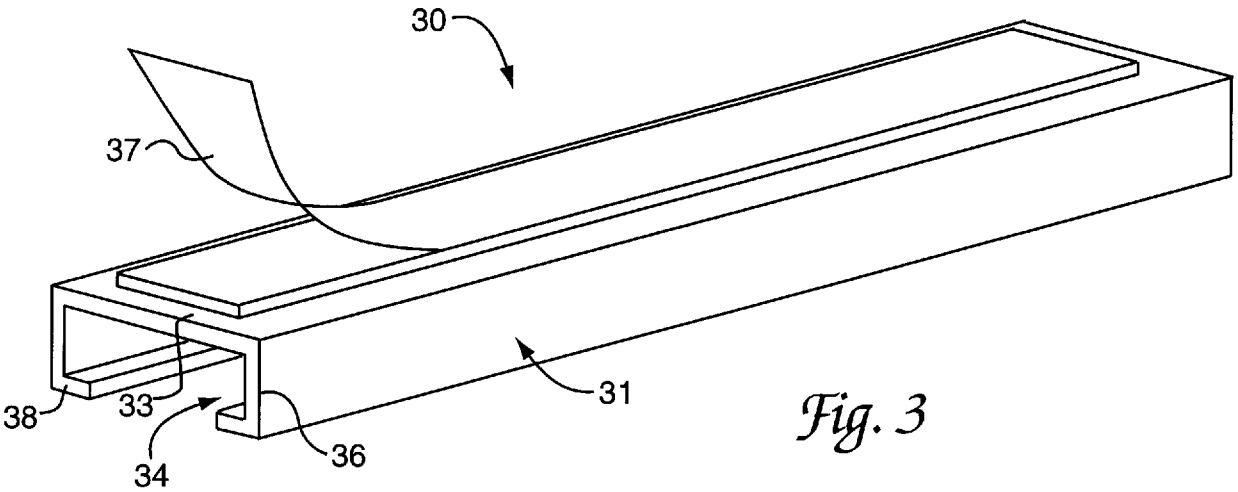
FIG. 3 is a diagrammatic back perspective view of the adhesive backed rail support channel shown in FIG. 1.

Referring next to FIG. 3, the support rail 30 will be described in more detail. The support rail includes a channel member 31 having a elongated web 33, and a pair of arms 36 which cooperate with a web to form a substantially U-shaped channel. Each of the arms 36 has an inturned lip 38 at its distal ends. The lips are arranged to face one another such that they form a constricted opening to the trough 34 formed by the U-shaped channel. The distal ends of the lips 38 are tapered on their outer surface so as to provide a funneling type entrance to the channel trough. A double-sided adhesive tape 39 is adhered to the back surface of the web 33. The adhesive tape includes a non-stick paper cover 37 which may be removed to expose the adhesive back surface of the double-sided tape. When the non-stick cover paper is removed, the support rail may be adhered to a mount board of any type, as seen for example in FIGS. 1, 2 and 8. The support rail can then be used as part of a support system to support the mount board.

A pair of stop pads or stoppers 61 may be provided or integrally formed on the inner surface of web 33 as best seen in FIG. 1 in order to prevent support structures such as slider arm support 40 from sliding out the end of the channel during use. The support rail 30 may be formed from a wide variety of materials. By way of example, an easily extruded metal such as aluminum works well. To improve the channel's appearance and prevent problems with corrosion, it may be desirable to coat the extruded material with a protective coating such as anodizing the aluminum. Of course, the protective coating is not required and indeed the support rail 30 may be formed from a wide variety of different materials, whether they be metallic, plastic, ceramic, etc.

The actual size of the support rails may vary widely in accordance with the needs of a particular frame. However, a web width of approximately ⅝-inch, an arm length of approximately 5/16-inch and a lip length of approximately ⅛-inch has been found to work well. A typical wall thickness may be on the order of approximately 1/20-inch. A suitable lip taper angle is approximately 45° where the lip extending in the neighborhood of 50% of the way down the thickness of the lip. Of course, the actual dimensions can be widely varied. However, the described sizes worked well with standard hangers.

Figure 5:
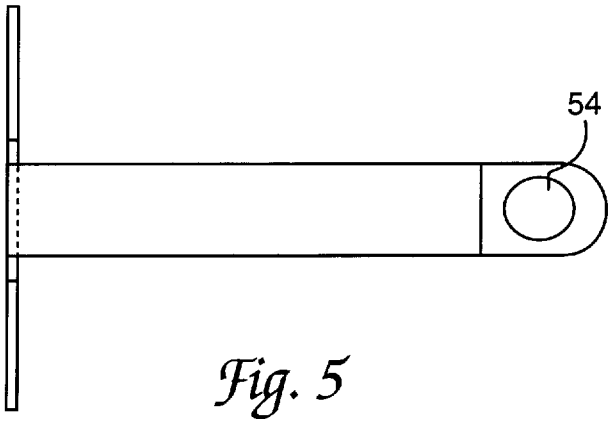
FIG. 5 is a diagrammatic bottom view of the support member shown in FIG. 4.
Figure 4:
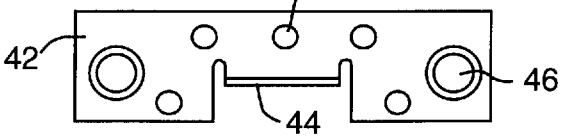
FIG. 4 is a diagrammatic front view of a slider support member in accordance with one embodiment of the present invention.

Referring next to FIGS. 4 and 5, a slider arm support 40 in accordance with one embodiment of the invention will be described in more detail. The slider arm 40 includes a slider member 42 and the support arm 44 which extends transversely from the slider member.

The slider 42 has a pair of threaded holes 46 positioned near opposite ends of the slider. The support arm 44 extends from a central portion of the slider. A plurality of smaller openings 48 are also provided at appropriate positions about the slider member 42. The openings 48 may receive fasteners such as small diameter nails, tacks and/or staples in order to fasten the slider to a wood frame as will be discussed below with reference to FIG. 7*a*. The threaded holes 46 are arranged to receive threaded studs 51 which are used to secure the slider to a channel type support rail. The arms 44 extend transversely from the slider 42. A cushion pad 54 may be provided on the bottom surface of the support arm to prevent the support arm from scratching furniture or other objects that the picture frame is set on. The cushion pad may be formed from a wide variety of materials. By way of example, a small circular felt pad has been found to work well.

The appropriate dimensions for the slider arm support 40 will vary widely in accordance with the type and size of picture frame that is intended to be used. By way of example, a suitable length for the slider member 42 is approximately two inches, a suitable width is on the order of just under a half inch. The length of the arm support 44 may also be varied a great deal. By way of example, a length of approximately three inches has been found to work well. More generally arm supports in the range of one to six inches have been found to work well for most conventionally sized mount boards.

The arm support 44 extends transversely relative to the slider member 42. The slider 42 and the support arm 44 are preferably integrally formed. By way of example, the slider arm support 40 may be formed from a suitable metallic material such as steel. Like the support rail 30, the slider arm 40 may be coated with a protective coating to reduce its abrasive properties and improve its appearance. One advantageous property of metallic materials is that when sized appropriately, they may be bent somewhat and still retain their strength. This is an advantage so that the user can adjust the angle at which the picture frame will rest when it is sitting in a free standing position.

When used in cooperation with a support rail 30 as seen in FIG. 1, the slider portion 42 of the slider arm support 40 can be inserted into the rail's channel trough 34. Then a pair of threaded studs 51 are screwed into threaded holes 46 until they contact the inner surface of web 33. The studs are further turned until a front surface of the slider is pressed into engagement with the channel lips 38. With both studs 51 tightened firmly, the slider arm support 40 will be firmly secured to rail 30 which in turn provides a solid support for picture frame 25.

Referring next to FIG. 2, an alternative embodiment of the invention will be briefly described. In this embodiment, four support rails 30 are attached to the back surface of a picture mat 25 in a manner that substantially forms a rectangle. Conventional corner pieces 78 may be used to connect the sides of the rectangles. The corner pieces 78 are merely connecting pieces that are suitable for sliding into the troughs 34 of the rail channel 31. Threaded studs 51 which engage threaded holes in the corner pieces may be used to firmly secure the corner pieces to the rail channels in the same manner that the slider is attached to the rail channels. A rectangular rail system as seen in FIG. 2 is very convenient from the standpoint that it permits the mount board 25 to be used in any orientation. Specifically, the slider arm support 40 can be placed in any of the side channels in the channel system in order to permit the mount board to be free standing in any orientation. Alternatively, any of the side channels standing alone may be used to hang the mount board.

Figure 6:
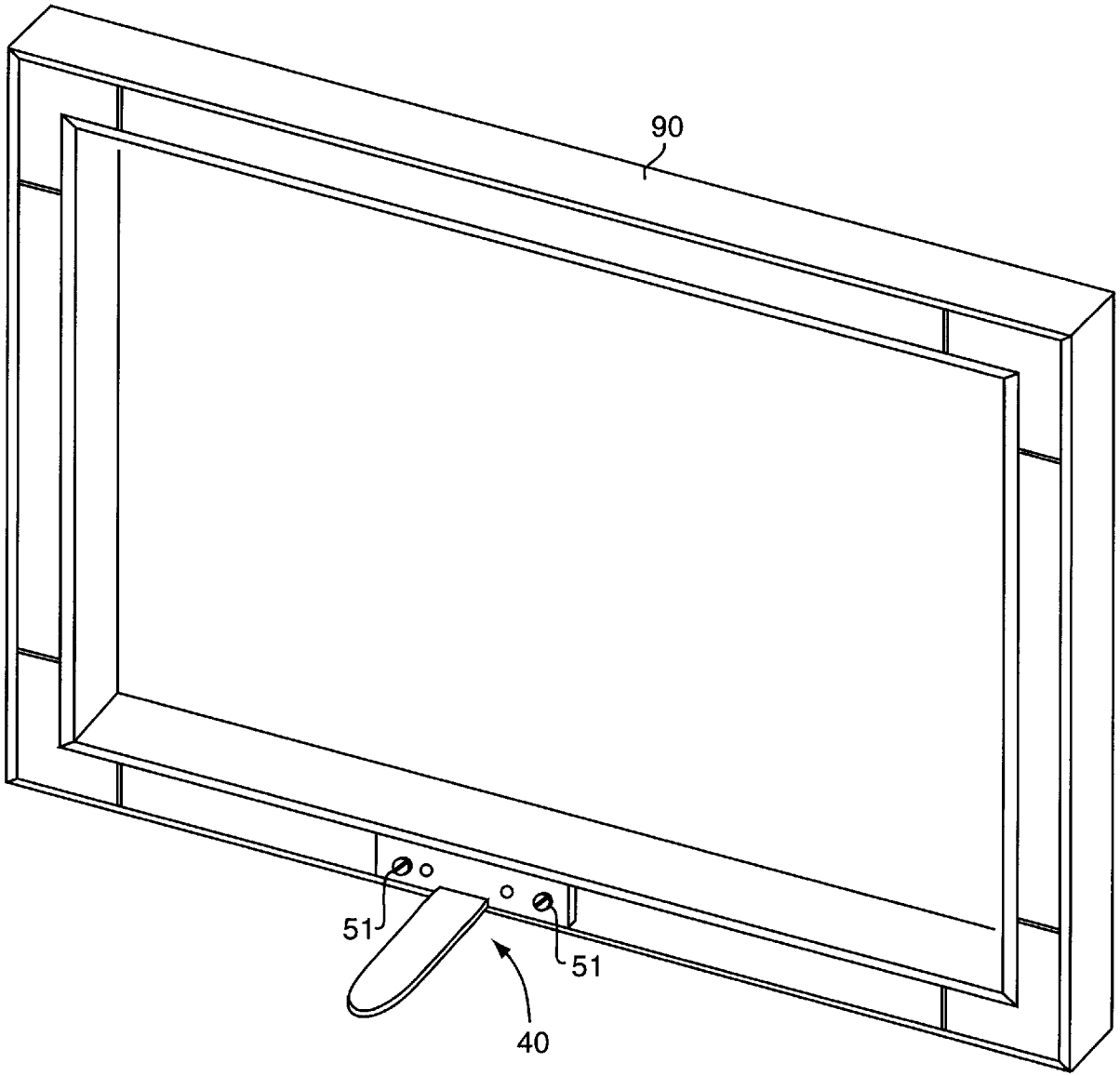
FIG. 6 is a diagrammatic back perspective view of a conventional channel backed picture frame that utilizes a free standing support arrangement in accordance with one aspect of the present invention.

Referring next to FIG. 6, it should be appreciated that the described slider arm support 40 can also be used with conventional metal picture frames such as the picture frame 90 shown in FIG. 6. As is well known to those skilled in the art, metal frames that include an integrally formed rail arrangement are well known to the prior art. One standard size is the ⅝-inch wide rail with a ⅜-inch wide opening to the rail's channel. Accordingly, the described slider arm support 40 can be mounted to such standard metal frames in the manner described above with reference to FIG. 1 and as shown in FIG. 6.

Figure 7A:
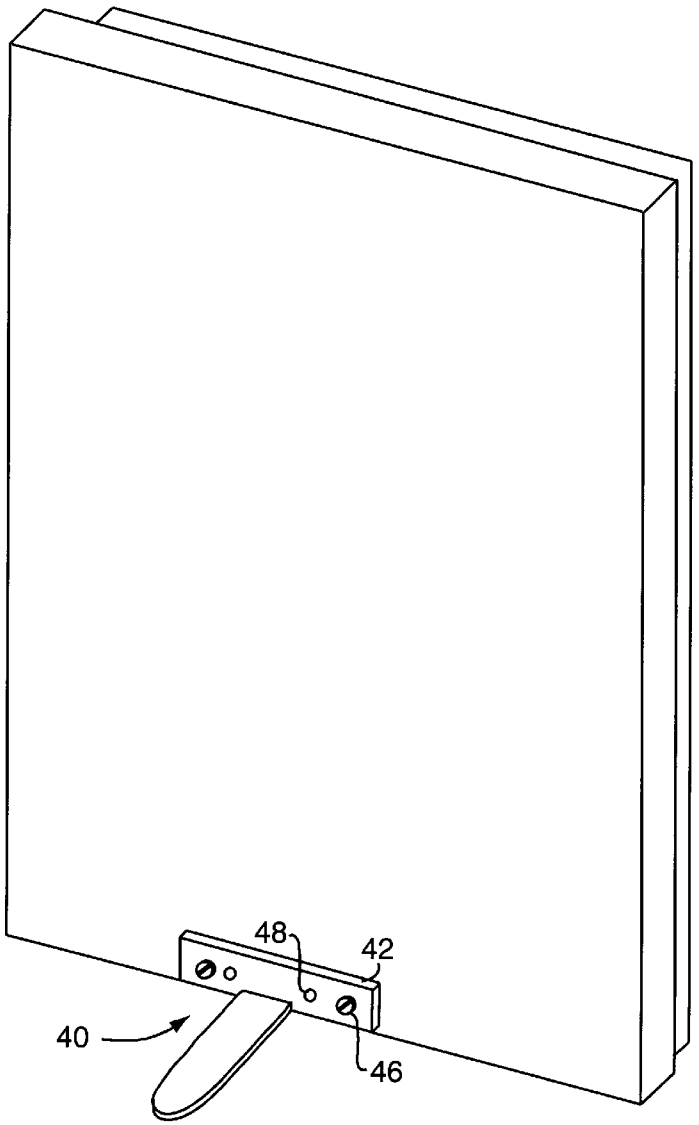
FIG. 7*a* is a diagrammatic back perspective view of a conventional flat backed plaque that utilizes a free standing support arrangement in accordance with another aspect of the present invention.

Referring next to FIG. 7*a*, it should be apparent that the described slider arm support 40 can also be used in conjunction with standard wood frames. Specifically, the slider 42 can be nailed, stapled or pinned to the back of a wooden frame by using suitable fasteners. The fasteners can be inserted either through the threaded holes 46 or the smaller openings 48 best shown in FIG. 4, and as described above.

Figure 7B:
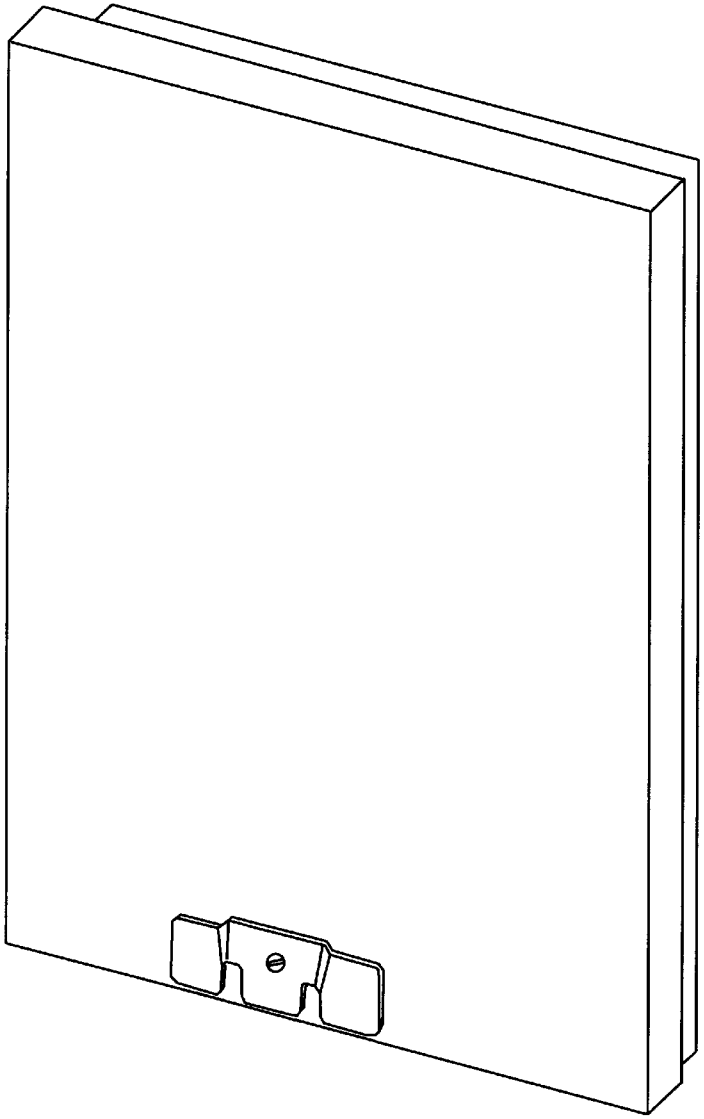
FIG. 7*b* is a diagrammatic back perspective view of a conventional flat backed plaque that utilizes an E-shaped three pring hook to support a free standing support arrangement in accordance with another aspect of the present invention.

In an alternative embodiment, the slider portion 42 of the slider arm support 40 can be used to engage a hook mounted on the back side of a frame. By way of example, the slider may engage an E-shaped three prong hook having a center prong attached to the frame and a pair of raised side prongs as shown in FIG. 7*b*. In this embodiment, no screws, studs or nails are required to couple the slider arm support 40 to the frame. By mounting the three prong hook such that it faces downward, the slider portion 42 may be positioned in the hook with the support arm 44 positioned to extend outward between the raised side prongs. The slider portion 42 is slid between the attached center prong and the raised outer prongs to couple the slider arm support to the hook, thereby supporting the frame.

Figure 8B:
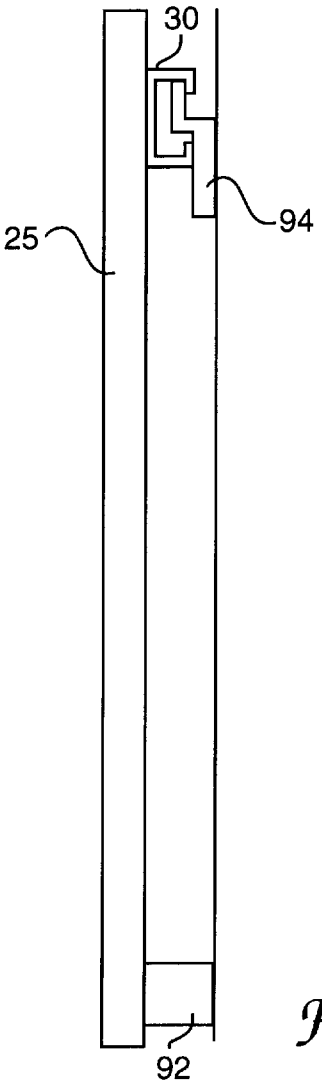
FIGS. 8*a* and 8*b* are diagrammatic end views of a picture mat incorporating a rail support channel illustrating its use in conjunction with a wall hanger to support a mount board.
Figure 8A:
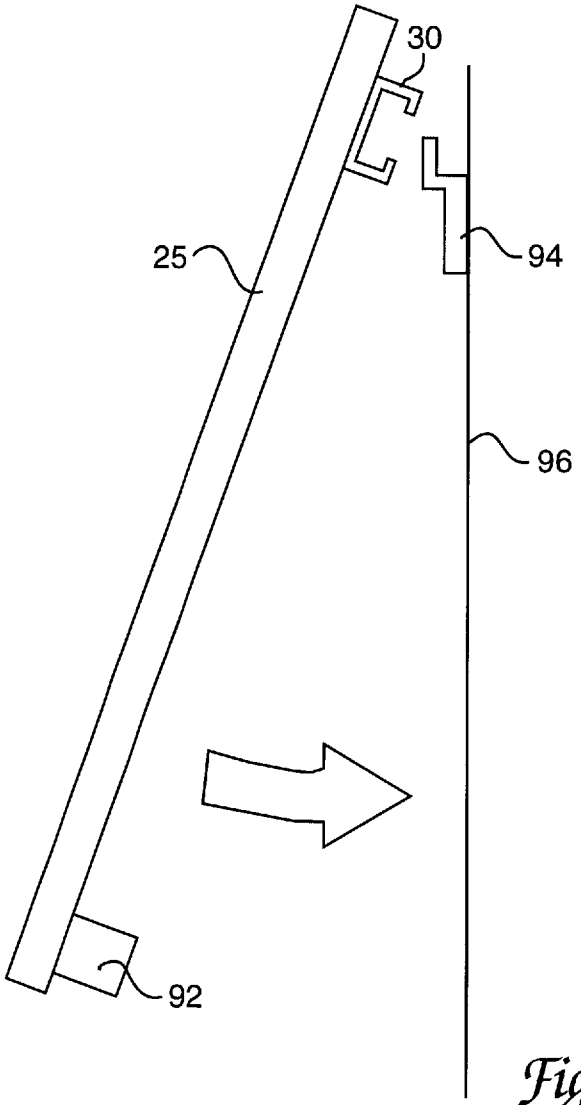

Referring next to FIGS. 8*a* and 8*b*, it should be appreciated that the described rail channels can also be used independently to permit a mount board to which it is attached to be wall mounted. Specifically, as seen in FIG. 8*a*, a mount board 25 having a support rail 30 on one end and a bumper 92 on another end may be attached to a conventional picture frame wall hanger 94 that is tacked into a wall 96. When properly installed, the picture frame 25 will hang as diagrammatically illustrated in FIG. 8*b*. Alternatively, a wide variety of conventional hangers such as snap in saw tooth hangers can be used in conjunction with the rail channels.

Figure 9A:
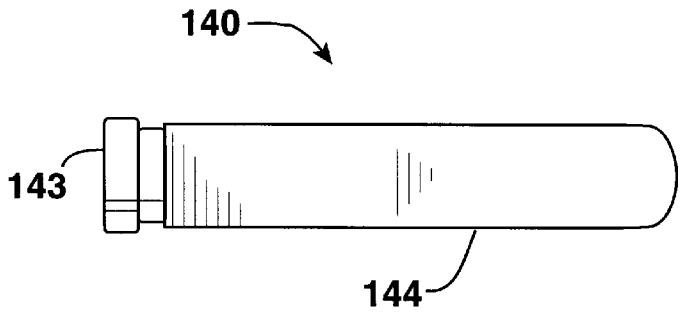
FIGS. 9*a*–9*c* are diagrammatic top, side and end views of a locking cam support member in accordance with another embodiment of the present invention.
Figure 9B:
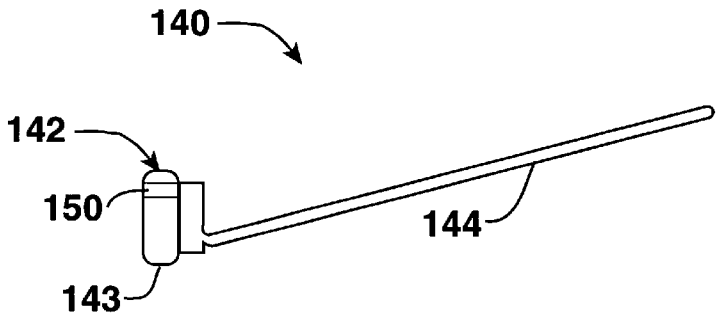
Figure 9C:
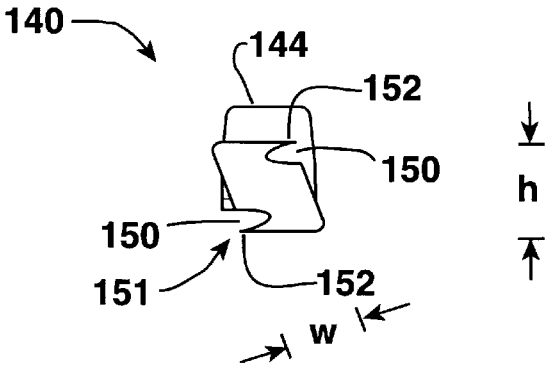

Referring next to FIGS. 9*a*–9*c*, an alternative support arm arrangement 140 is illustrated. In this embodiment, the slider member based coupling mechanism (as illustrated in FIGS. 4 & 5) is replaced by a cam based coupling mechanism 142. The support arm arrangement 140 includes a support arm 144 which extends transversely from a cam member 143. The cam member 143 is arranged to secure the support arm arrangement to a channel type support rail. Accordingly, the cam member 143 has a width (w) that is slightly narrower than the opening between the rail's lips. At the same time, its height (h) is about the width of the full rail trough and, importantly, wider than the opening between the rail's lips. That is, it is about the same height as the distance between the channel arms.

In the embodiment shown, the cam member 143 has a substantially parallelogram type shape, with notches 150 cut adjacent the diagonal corners 151 that are closest together so as to form projections 152 that extend along opposite sides of the cam member. The projections 152 serve to lock the cam member in place during use. When used in cooperation with a support rail 30 as seen in FIG. 1, the coupling mechanism of the support arm arrangement 140 can be inserted into the rail's channel trough 34. Then the entire member is then twisted such that the short diagonal corners first come into contact with associated channel arm and further such that the opposing sides 156 and 157 of the cam member come into contact with the channel arms, thereby holding the support arm arrangement 140 in place. Thus, the cam member 143 acts as a locking cam.

The actual dimensions of the support arm arrangement 140 may be varied in accordance with the needs of any particular system. However, cams adapted to engage channels having the dimensions set forth above and having support arm lengths 144 on the order of one to six inches as discussed above have been found to work well. The support arm arrangement may be formed from any suitable materials. In a preferred embodiment, the slider 42 and the support arm 44 are integrally formed, although this is not a requirement. By way of example, plastic has been found to work well. When desired, and especially when metal or other hard materials are used as the support arm, a cushion pad 54 may be provided on the bottom surface of the support arm to prevent the support arm from scratching furniture or other objects that the picture frame is set on as discussed above. Similarly, when metal or other hard materials are used, the support arm may be coated with a protective coating to reduce its abrasive properties and improve its appearance.

Figure 10A:
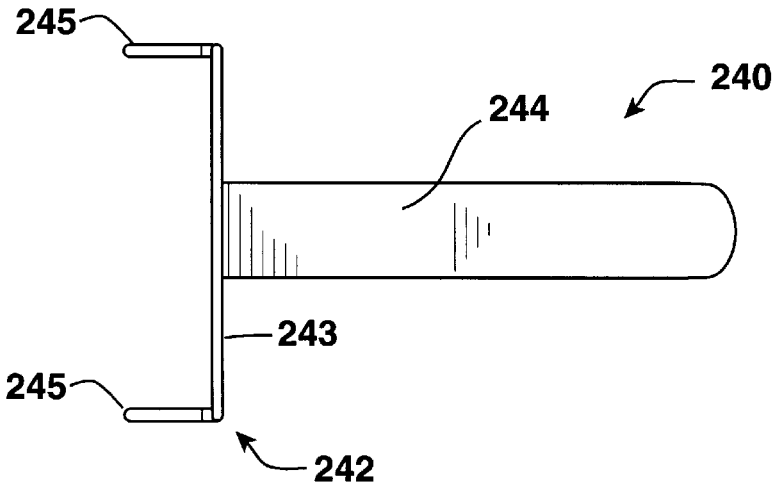
FIGS. 10*a*–10*c* are diagrammatic top, side and end views of a spike support member in accordance with another embodiment of the present invention.
Figure 10B:
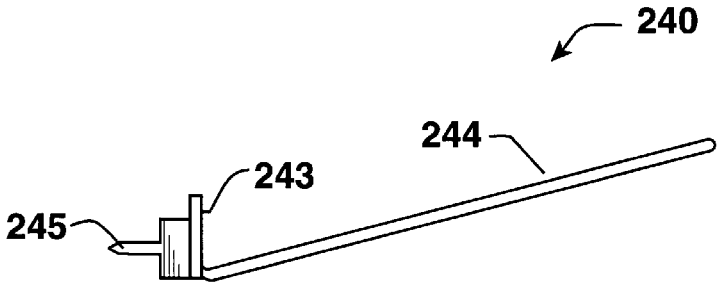
Figure 10C:
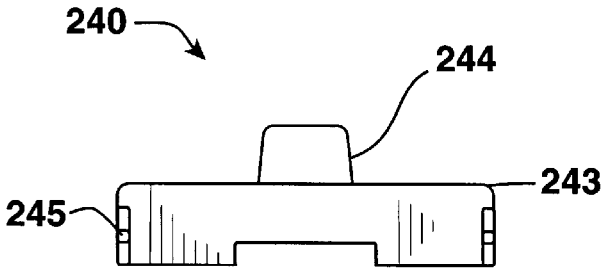

Referring next to FIGS. 10*a*–10*c* another alternative support arm arrangement 240 is illustrated. In this embodiment, the slider member based coupling mechanism (as illustrated in FIGS. 4 & 5) is replaced by a spike based coupling mechanism 242. The support arm arrangement 240 includes a support arm 244 which extends transversely from a base 243. The base 243 has a pair of spikes 245 that may be driven into a wooden frame or the like to couple the support arm arrangement 240 to the frame. The actual geometry, size and spacing of the base 243, the support arm 244 and the spikes 245 may be widely varied. The support arm arrangement may be formed from any suitable materials. By way of example, metal has been found to work well. When desired, a cushion pad 54 may be provided on the bottom surface of the support arm to prevent the support arm from scratching furniture or other objects that the picture frame is set on as discussed above. Similarly, when metal or other hard materials are used, the support arm may be coated with a protective coating to reduce its abrasive properties and improve its appearance.

Although only a few embodiments of the present invention have been described in detail, it should be understood that the present invention may be embodied in many other specific forms without departing from the spirit or scope of the invention. Particularly, the materials from which the support rail and/or the slider arm support are formed may be widely varied. Of course, the sizes of the components can also be varied in accordance with the needs of a particular system. As has been explained with reference to some of the drawings, the support rail and the slider arm support may be used either independently or in combination to facilitate supporting a suitable picture frame.

In the specification, two support arm arrangement coupling mechanisms have been described in detail. That is the cam based system and the slider based system. Of course, a variety of alternative coupling mechanisms could be used in their place. In cam based systems, the geometry of the cam may be varied a great deal without departing from the spirit or scope of the invention. By way of example, when desired, the notches 150 may be eliminated and replaced by rounded comers.

Frequent reference has been made to the support of picture frames and mount boards. It should be appreciated that within the context of this description, the terms picture frame and mount board are intended to be a generic term that includes picture frames of any type including wooden, metallic, plastic, glass, cardboard and other picture frames, as well as mount boards, mats and plaques. The drawings show the use of the slider arm support and the support rail in a variety of configurations, however, it should be appreciated that framers may use the components in a wide variety of different orientations and configurations as well. Therefore, the present examples are to be considered as illustrative and not restrictive, and the invention is not to be limited to the details given herein, but may be modified within the scope of the appended claims.

We claim:

1. A reusable picture frame support means suitable for supporting a plurality of different types of picture frames in a free standing manner, wherein a first type of supportable picture frame has a front display plane, a rear surface and a frame support rail attached to said rear surface that defines a channel with a constricted opening that faces away from the display plane, the picture frame support means comprising:

a slider sized appropriately to be received within and releasably engaged with a channel of a frame support rail of a first type of picture frame, wherein the slider is further sized such that the slider is insertable through the constricted opening of the channel of the first type of picture frame, the slider including a plurality of threaded holes and a plurality of additional openings;

an elongated support arm extending transversely from the slider, wherein the slider is suitable for cooperating with an inner surface of the channel of the first type of picture frame to secure the picture frame support means to the frame support rail of the first type of picture frame, whereby when said slider secures the picture frame support means to the frame support rail, the support arm extends transversely away from the display plane of the picture frame supported by said picture frame support means in a manner suitable to support the first type of picture frame in a free standing manner; and a means suitable for securing said slider to a second type of picture frame to be supported by said picture frame support means, the securing means including members configured to pass through the plurality of the additional openings which are arranged to receive such securing means, and engage with the rear surface of the second type of picture frame to firmly hold the picture frame support means in place, with the support arm extending transversely away from the display plane, to facilitate supporting the second type of picture frame in a free standing manner without a support rail.

2. A reusable picture frame support means suitable for supporting a picture frame in a free standing manner, wherein the picture frame has a display plane and a support rail that defines a channel with a constricted opening that faces away from the display plane, the picture frame support means comprising:

a coupling member sized appropriately to be received within and releasably engaged with a channel of a frame support rail of a picture frame having a display plane, wherein the coupling member is further sized such that the coupling member is insertable through a constricted opening of the channel; and an elongated support arm integrally formed with the coupling member and extending transversely from the coupling member wherein the coupling member is suitable for cooperating with an inner surface of the channel to secure the picture frame support means to the frame support rail, whereby when said coupling member is arranged to secure the picture frame support means to the frame support rail, the support arm extends transversely away from the display plane of the picture frame supported by said picture frame support means to support the picture frame in a free standing manner, whereby the coupling member is suitable for being inserted directly through the constricted opening portion of the frame support rail to facilitate attaching the picture frame support means to the picture frame: and wherein the coupling member is further configured to engage an E-shaped three prong hook attached to the picture frame supported by the support means on opposing sides of said elongated support arm in an alternative mounting arrangement, whereby the support arm extends away from the display plane to support the frame in a free standing manner.

3. A reusable picture frame support means suitable for supporting a picture frame in a free standing manner, wherein the picture frame has a display plane and a support rail that defines a channel with a constricted opening that faces away from the display plane, the picture frame support means comprising:

a coupling member sized appropriately to be received within and releasably engaged with a channel of a frame support rail of a picture frame having a display plane, wherein the coupling member is further sized such that the coupling member is insertable through a constricted opening of the channel; and an elongated support arm integrally formed with the coupling member and extending transversely from the coupling member, wherein the coupling member is suitable for cooperating with an inner surface of the channel to secure the picture frame support means to the frame support rail, whereby when said coupling member is arranged to secure the picture frame support means to the frame support rail, the support arm extends transversely away from the display plane of the picture frame supported by said picture frame support means to support the picture frame in a free standing manner; and wherein said coupling member further includes openings on either side of said support arm, the openings configured to receive a projection there through, whereby when said coupling member receives the projection, the support arm extends transversely away from the display plane to support the frame in a free standing manner; and whereby the coupling member is suitable for being inserted directly through the constricted opening portion of the frame support rail to facilitate attaching the picture frame support means to the picture frame.

* * * * *